US007789383B2

(12) United States Patent
Grizzell

(10) Patent No.: US 7,789,383 B2
(45) Date of Patent: Sep. 7, 2010

(54) SADDLE STITCHER FOR PAPERBACK BOOKS

(76) Inventor: Gary L. Grizzell, 2128 Crystal Ct., Cookeville, TN (US) 38501

( * ) Notice: Subject to any disclaimer, the term of this patent is extended or adjusted under 35 U.S.C. 154(b) by 360 days.

(21) Appl. No.: 12/099,824

(22) Filed: Apr. 9, 2008

(65) Prior Publication Data

US 2009/0256300 A1 Oct. 15, 2009

(51) Int. Cl.
*B65H 37/04* (2006.01)

(52) U.S. Cl. ..... 270/58.08; 270/52.26; 270/52.18; 270/58.07; 270/58.11; 270/58.12; 270/37; 412/6; 412/33

(58) Field of Classification Search ..... 270/37, 270/52.18, 52.26, 58.07, 58.08, 58.11, 58.12; 412/6, 18, 20, 25, 33; 227/110, 111, 154, 227/155

See application file for complete search history.

(56) References Cited

U.S. PATENT DOCUMENTS 3,630,428 A * 12/1971 Olney et al. ..... 227/128
5,377,965 A 1/1995 Mandel et al.
5,678,813 A 10/1997 Osako et al.
6,578,838 B2 * 6/2003 Trovinger et al. ..... 270/52.18
2006/0071414 A1 4/2006 Kawatsu et al.
2007/0128004 A1 * 6/2007 Trovinger et al. ..... 412/1

* cited by examiner

*Primary Examiner*—Leslie A Nicholson, III
(74) *Attorney, Agent, or Firm*—Pitts & Brittian, P.C.

(57) ABSTRACT

A saddle stitcher for making paperback books is provided by the present invention. The saddle stitcher is provided for manually assembling one or a few (or a greater number if desired by the user) booklets in a cost-effective, yet professional manner. The saddle stitcher generally includes a tray, a saddle, and a plurality of staplers. The tray is provided for receiving a plurality of pages to be made into a booklet and in which the pages are stitched to form the booklet. The staplers are provided for stitching the plurality of pages to form a booklet and are pivotally and slidably mounted within the tray in order to accommodate booklets of varying sizes. An engagement device is provided for engaging each of the staplers in tandem in order to fabricate a booklet.

15 Claims, 8 Drawing Sheets

SADDLE STITCHER FOR PAPERBACK BOOKS

CROSS-REFERENCE TO RELATED APPLICATIONS

Not Applicable

STATEMENT REGARDING FEDERALLY-SPONSORED RESEARCH OR DEVELOPMENT

Not Applicable

BACKGROUND OF THE INVENTION

1. Field of Invention

The invention relates to a device for saddle stitching booklets. More specifically, the present invention is a device for manually saddle-stitching, or stapling, a booklet comprised of one or more folded sheets of printed material and/or binding material.

2. Description of the Related Art

In the field of publishing, it is well known that desktop publishing has evolved to the point that any computer user has the ability to publish their own printed materials in any selected format. Once printed, the user is faced with the decisions as to how to finish the material. The selected method of binding and the format of the printed are interrelated.

For a print job of one or a few copies, it is typically most economical to format the print job for edge binding, such as with a comb binder, staples, or the like. This is due in large part to the costs associated with the necessary binding equipment. For booklet binding, however, available equipment is typically provided for mass production of booklets. Accordingly, such equipment is typically too expensive to afford for occasional use. To this extent booklets are typically "stitched" using two or more "stitches" or staples. The staples are aligned along a fold line, about which the booklet is folded. While it is possible to use a conventional stapler to accomplish booklet binding, results are inconsistent, and alignment of the staples on the fold line and in alignment with each other is difficult.

Other devices have been provided for saddle stitching a booklet, or for assisting in the finishing of a booklet that is bound by saddle stitching. Typical of the art are those devices disclosed in the following U.S. Patents and Patent Application:

| Patent/Pub No. | Inventor(s)/Country | Issue Date |
|---|---|---|
| 3,630,428 | N. M. Olney et al. | Dec. 28, 1971 |
| 5,678,813 | T. Osako et al. | Oct. 21, 1997 |
| 5,377,965 | B. P. Mandel et al. | Jan. 3, 1995 |
| 2006/0071414 | K. Kawatsu et al. | Apr. 6, 2006 |

In the '428 patent issued to Olney et al., what is described is now a conventional stapler manufactured by Swingline, Inc. Of interest in the present application, the '428 device is a stapling machine having a base, an anvil upon the base, an invertible magazine having a staple discharge opening and staple feeding means pivotally connected to the base, a cover overlying the magazine and pivotally connected to the base and magazine, and a cap overlying the cover and also pivotally connected to the base. The anvil is formed with chamfers on its leading and trailing edges and on its underside and provided with selectively engageable pinning and clinching portions. The magazine and associated structures are connected to the base by a pin passing through a pair of spaced ears.

Osako et al., in their '813 patent, disclose a bookbinding method for the mass production of books. The '813 method includes feeding body signatures from a plurality of body signature feeders disposed in parallel, to a conveyor below the body signature feeders and stacking the body signatures on the conveyor. The stacked body signatures are then saddle-stitched. A series of stitched portions are then glued and pressed, then glued within a cover to form a book.

Mandel et al., in their '965 patent, disclose an automatic on-line signatures booklets finisher for electronic printers. The Mandel device is provided for on-line center folding of sets of signature sheets output by a reproduction system. Signature sheets are sequentially and individually folded in a folding rollers nip as they are outputted. The nip is reversed at a position in which the opposite ends of the sheet engage the opposite sides of a closely adjacent saddle compiler to sequentially stack the folded signature sheets on the saddle compiler to form plural sheet compiled pre-folded signature sheet booklets. The signature booklets are then stapled and ejected through the same folding rollers nip to a booklet output system which may perform edge trimming and stacking of the booklets.

In their '414 application, Kawatsu et al., disclose a paper conveying apparatus for use in association with a signature booklet finishing processes, including folding, saddle stitching and for edge cutting. The apparatus includes: a first conveying section to convey the paper in a first conveyance direction; a second conveying section that includes a conveyance belt, including a conveying nail, to deflect the conveying direction of the paper and conveys the paper in a second conveyance direction, which is substantially orthogonal to a longitudinal direction of a leading edge of the paper; a stopper member for stopping and releasing a side edge portion of the paper in a width direction of the paper; and a driving section to drive both the conveyance belt and the stopper member. The driving section moves the conveying nail and/or the stopper member from an outside of a paper conveying area, to achieve a width truing operation.

The MBM Corporation (North Charleston, S.C.) manufactures a "Bookletmaker Jr." (http://www.mbmcorp.com/finishing-product.php?id=107), which is provided for stapling and folding booklets. The Bookletmaker Jr. is provided for mass production of booklets (up to 250/hour). This device is also heavy (40 pounds), likely due to the electric motor and the roller assembly, making it inconvenient for only occasional use. Further, as noted on the referenced site, this device is not economical for the occasional user.

BRIEF SUMMARY OF THE INVENTION

A saddle stitcher for making paperback books is provided by the present invention. The saddle stitcher is provided for manually assembling one or a few booklets in a cost-effective, yet professional manner. The saddle stitcher is configured to accommodate various sizes of paper. Further, the saddle stitcher is configured to allow for unencumbered placement of paper to be stitched and removal of a booklet after a plurality of stitches in the form of staples has been applied.

The saddle stitcher generally includes a tray, a saddle, and a plurality of stitchers or staplers. The tray is provided for receiving a plurality of pages to be made into a booklet and in which the pages are stitched to form the booklet. The tray includes at least a bottom wall, first and second side walls, and an end wall disposed at a first end of the bottom wall, with the second end of the bottom wall remaining open.

The staplers are provided for stitching the plurality of pages to form a booklet. Each stapler is pivotally and slidably mounted on a rod, which in turn is carried by the tray. An engagement device is provided for engaging each of the staplers in tandem in order to fabricate a booklet. In the illustrated embodiment, the engagement device includes a post carried by the cover of each stapler, proximate the distal end thereof. An elongated push board defines a groove on a bottom surface thereof, the groove being configured to closely receive the post associated with each stapler. When the staplers are in a lowered orientation, the push board is placed such that the posts are received within the groove. A user pushes down on the push board in order to actuate each of the staplers in unison to form the booklet.

A position indicator is provided for assisting a user in properly positioning each stapler. A set of stapler positioning indicia are carried on the top of the first end wall. A pointer is carried by the stapler cover and is configured to point to the indicia. The staplers are each moved to align its pointer with the appropriate indicia for a selected size booklet.

The saddle is carried within the tray and extends between the first and second side walls. The saddle is provided for receiving a plurality of pages to be formed into a booklet thereon, and for supporting the pages as they are being stapled to form the booklet. The saddle includes primarily a base for mounting the saddle onto the tray. First and second engagement surfaces are provided for supporting the plurality of pages. The first and second engagement surfaces define an upper edge and a lower edge. The lower edge terminates above the bottom wall of the tray to define a gap. A receiver is defined along the length of the saddle between the upper edges of the first and second engagement surfaces. The receiver is configured to slidably receive a plurality of clincher plates.

A plurality of clincher plates is slidably received on the saddle. Each clincher plate defines an anvil, which in turn defines a clinching recess. The anvil defines an extended portion configured to be received within the receiver defined by the saddle. The clinching recess is configured to engage the points of a staple and deform the staple such as to clinch the staple onto a bottom sheet of paper forming the innermost page of the booklet. Each clincher plate defines a pair of legs configured to be received over the first and second engagement surfaces of the saddle. The distal end of each of the first and second legs defines an engagement device for engaging the lower edge of the first and second engagement surfaces, respectively. The distal end of each of the first and second legs further defines a pointer for indicating the position of the clincher plate with respect to the saddle. To this extent, indicia are carried on the bottom wall of the tray.

A width adjuster is provided for aligning each of the sheets being bound. The width adjuster is slidably received on the saddle in order to prevent each sheet from movement away from the first side wall of the tray, thus keeping the plurality of sheets in alignment with each other while being stitched. Each width adjuster defines a pair of legs configured to be received over the first and second engagement surfaces of the saddle. The distal end of each of the first and second legs defines an engagement device for engaging the lower edge of the first and second engagement surfaces, respectively. The distal end of each of the first and second legs defines a pointer for indicating the position of the width adjuster with respect to the first side wall.

In a method of fabricating a booklet, the present invention includes the steps of: moving the clincher plates to selected positions along the saddle as determined by the height of the sheets; moving the staplers along the rod to positions corresponding to the clincher plates; pivoting the staplers about the rod to a vertical orientation to allow access to the saddle; moving the width adjuster along the saddle to the approximate height of the sheets; placing the sheets on the saddle; folding each of the plurality of sheets prior to placement on the saddle to define a fold line; moving the width adjuster to a position whereby the sheets are aligned with each other and are held securely against the first side wall; lowering the staplers to engage the top sheet; placing the elongated push board such that the posts on the stapler housings are received within the groove' applying a force to the push board such that each of the staplers is actuated to apply a staple to the sheets; and removing the booklet.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A saddle stitcher for making paperback books is provided by the present invention and illustrated in the figures. The saddle stitcher is illustrated generally at 10 in the figures. The saddle stitcher 10 is provided for manually assembling one or a few booklets in a cost-effective, yet professional manner. The saddle stitcher is configured to accommodate various sizes of paper. Further, the saddle stitcher 10 is configured to allow for unencumbered placement of paper 142 to be stitched and removal of a booklet 140 after a plurality of stitches in the form of staples 88 has been applied.

Figure 1:
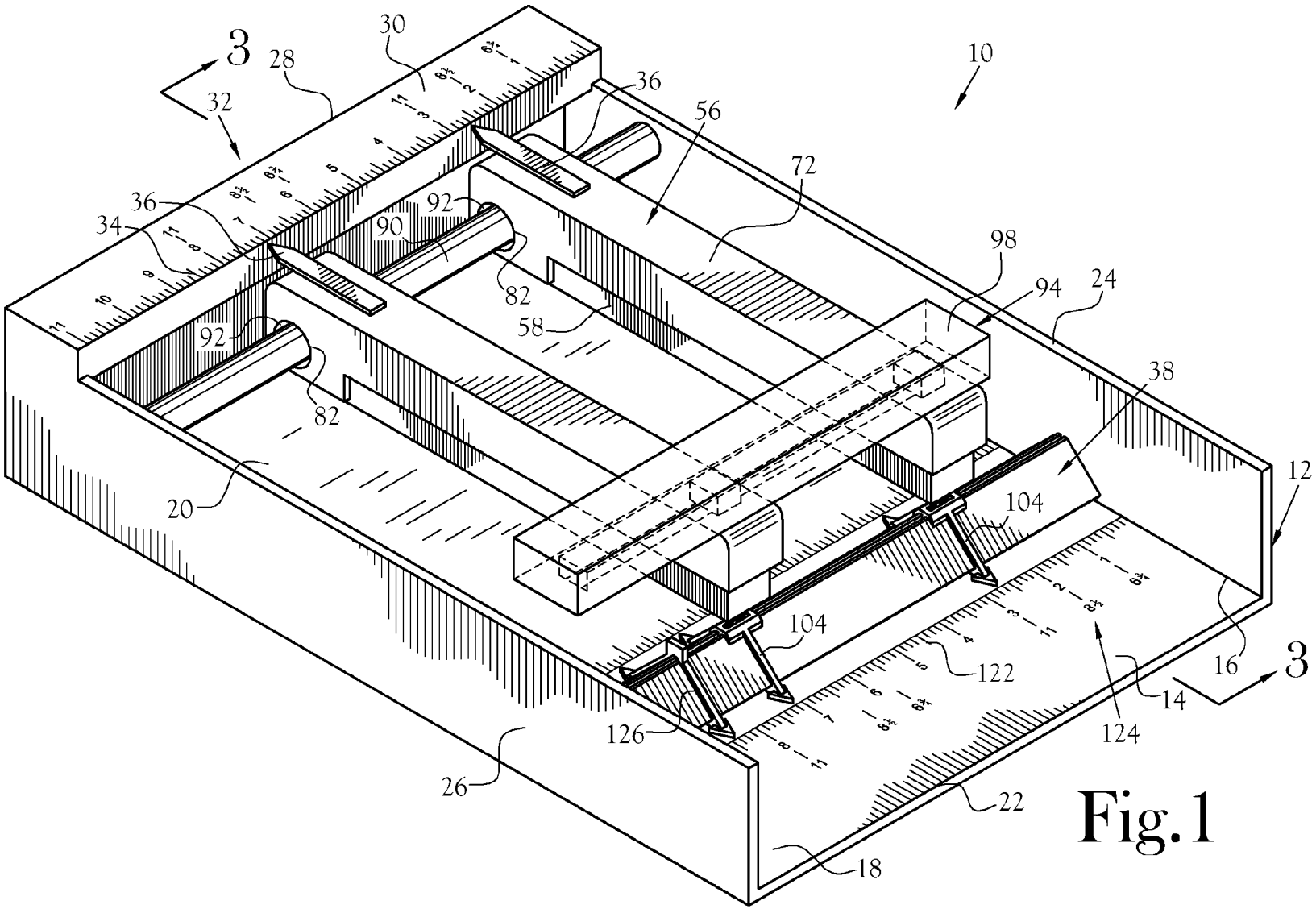
FIG. 1 is a perspective view of the saddle stitcher for paperback books of the present invention illustrating various features of the present invention.
Figure 2:
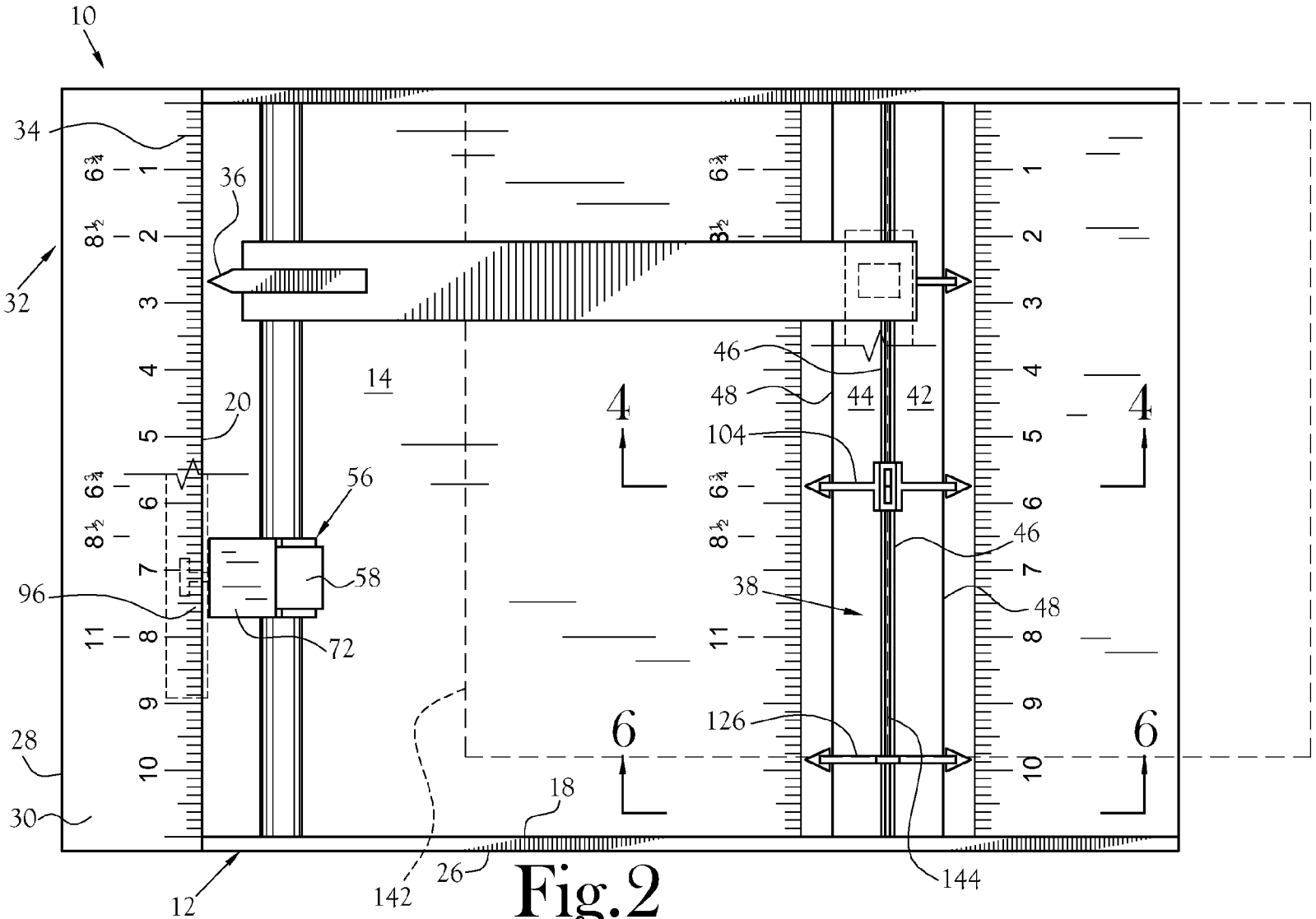
FIG. 2 is a top plan view of the saddle stitcher of FIG. 1 illustrating a first stapler head in a raised orientation and a second stapler head in a lowered orientation.
Figure 2A:
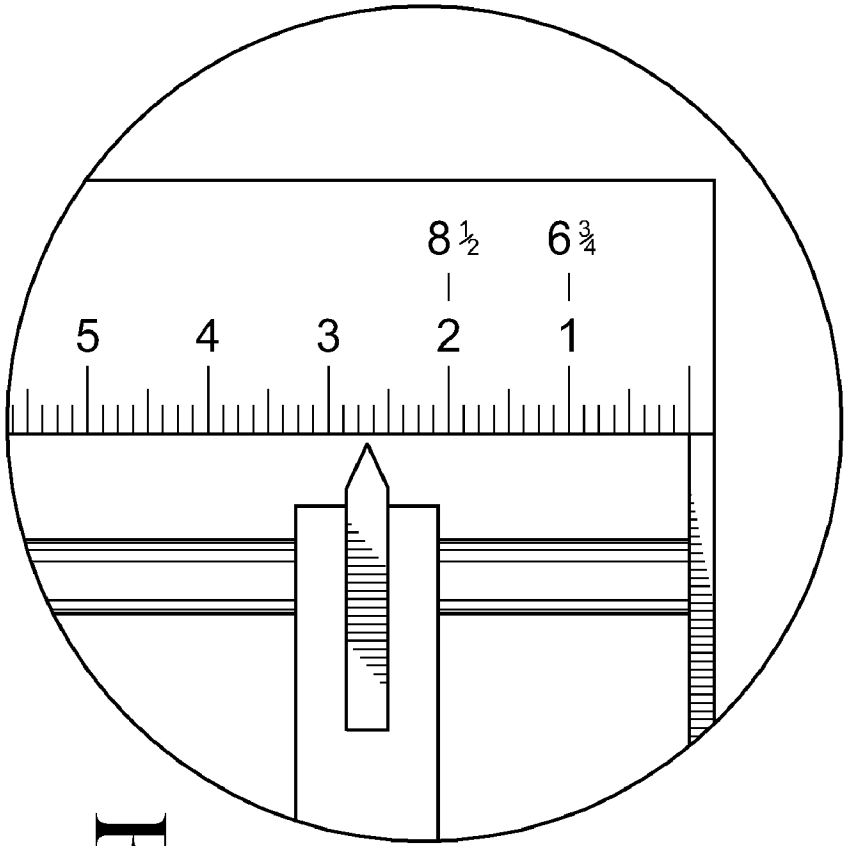
Figure 2B:
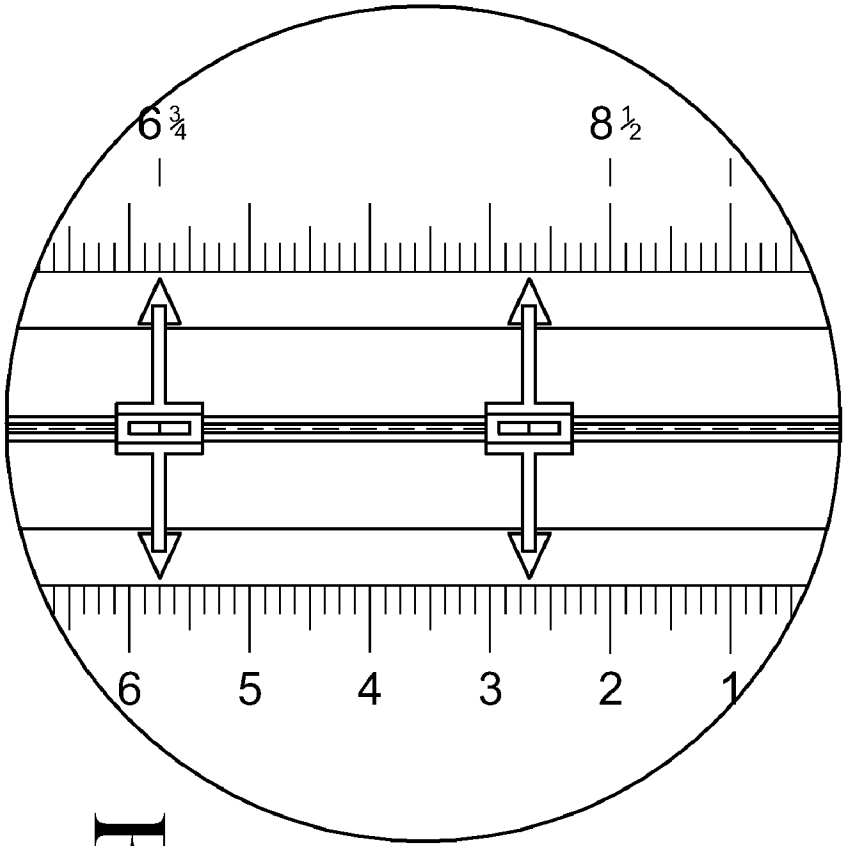

Referring to FIGS. 1 and 2, which respectively illustrate a perspective view and a top plan view of the saddle stitcher 10 of the present invention, the saddle stitcher 10 generally includes a tray 12, a saddle 38, and a plurality of stitchers or staplers 56. The tray 12 is provided for receiving a plurality of pages 142 to be made into a booklet 140 and in which the pages 142 are stitched to form the booklet 140. The tray 12 includes at least a bottom wall 14 and first and second side walls 24, 26 disposed on the first and second sides 16, 18, respectively, of the bottom wall 14. In the illustrated embodiment, the tray 12 further includes an end wall 28 disposed at a first end 20 of the bottom wall 14, with the second end 22 of the bottom wall 14 remaining open.

The staplers 56 are provided for stitching the plurality of pages 142 to form a booklet 140. In the illustrated embodiment, two staplers 56 are provided. Each stapler 56 defines a substantially conventional configuration, such as that disclosed by N. M. Olney et al., as discussed above in the Description of Related Art. Each stapler 56 includes primarily a magazine 58 for receiving staples 88 and defining a conventional staple discharge opening (not illustrated) and a cover 72 overlaying the magazine 58. The magazine 58 defines a proximal end 60 and a distal end 62, with the staple discharge opening being disposed at the distal end 62. The magazine 58 further defines side walls 66. At the proximal end 60 of the magazine 58, each of the side walls 66 defines a through opening 70 for receiving a rod 90.

Likewise, the cover 72 defines a proximal end 74 and a distal end 76, and side walls 78 configured to cover at least the top portion of the magazine 58. At the proximal end 60 of the cover 72, each of the side walls 78 defines a through opening 82 for receiving the rod 90. A conventional latching mechanism (not illustrated) is provided for selectively engaging and disengaging the cover 72 from the magazine 58. Further, a conventional stapler feed mechanism (not illustrated) is provided within the magazine 58/cover 72 assembly for biasing the staples 88 toward the staple discharge opening.

An engagement device 94 is provided for engaging each of the staplers 56 in tandem in order to fabricate a booklet 140. In the illustrated embodiment, the engagement device 94 includes a post 96 carried by the cover 72 of each stapler 56, proximate the distal end 76 thereof. An elongated push board 98 defines a groove 102 on a bottom surface 100 thereof, the groove 102 being configured to closely receive the post 96 associated with each stapler 56. As will be described below, the staplers 56 are configured to be moved toward and away from each other. Accordingly, the push board 98 and its associated groove 102 are configured to accommodate any relative spacing of the staplers 56. The push board 98 is placed such that the posts 96 are received within the groove 102 in such a way as to not be removed. To this extent, the groove 102 defines extended portions 103 (see FIG. 3) configured to be cooperatively received under a shoulder 97 defined by each of the posts 96, thereby preventing unselected removal of the push board 98 while also permitting lateral movement of either of the staplers 56 with respect to the other. It will be understood, however, that the push board 98 may be alternatively configured to be removable by eliminating the extended portions 103, thereby also permitting independent pivoting of the staplers 56 about the rod 90. It is noted in FIG. 2 that the staplers 56 are illustrated in two orientations, with the push board 98 being broken for clarity. A user pushes down on the push board 98 in order to actuate each of the staplers 56 in unison to form the booklet 140.

At least one bushing 92 is carried on the rod 90 and received within the openings 70, 82 defined in the proximal ends 60, 74 of each of the magazine 58 and cover 72, respectively. It will be understood that a single bushing 92 may be configured to be received within each of the through openings 70, 82, or individual bushings 92 may be configured to be received within one of the through openings 70, 82. The bushings 92 are provided for accommodating pivoting of each of the magazine 58 and the cover 72 independently from each other. The bushings 92 further allow for the independent sliding of each stapler 56 along the rod 90.

The rod 90 is carried by the first and second side walls 24, 26 of the tray 12, proximate the first end 20 thereof. The magazine 58 and cover 72 are independently pivotable about the axis of the rod 90. Each stapler 56 may be pivoted to a first substantially horizontal position for stapling a booklet 140 or when not in use, or to a second position away from horizontal in order to load paper 142 to be stapled to form a booklet 140 or to remove a booklet 140 that has been stapled. Further, the cover 72 is independently pivotable about the axis of the rod 90 with respect to the magazine 58 in order to reload the magazine 58 with staples 88.

As discussed with respect to the bushings 92, and in order to accommodate various sizes of booklets 140, each of the staplers 56 is independently movable along the axis of the rod 90. For smaller booklets 140, it may be desirable to move the staplers 56 closer to each other and closer to the first side wall 24. However, for larger booklets 140, it may be desirable to move the staplers 56 away from each other and away from the first side wall 24.

A position indicator 32 is provided for assisting a user in properly positioning each stapler 56. In the illustrated embodiment, a set of stapler positioning indicia 34 are carried on the top of the first end wall 28. A pointer 36 is carried by the stapler cover 72 and is configured to point to the indicia 34. It will be understood that the indicia 34 may include a standard ruler configuration to illustrate the distance from the first side wall 24, may indicate a position at which the stapler 56 is to be disposed for a particular size paper 142, or may indicate both. In the illustrated embodiment, both sets of indicia 34 are illustrated. For a booklet 140 whose height is 6¾", it may be desirable to position the center of the staples 88 at 1" and 5¾" from the first side wall 24. The first stapler 56 is thus moved to align its pointer 36 with 1", which is also indicated as (6¾"), and the second stapler 56 is moved to align its pointer 36 at 5¾", which is also indicated as (6¾"). In the latter example, the indicia 34 include two marks for each dimension, with one mark being provided for aligning each stapler 56. Illustrated for example purposes only are two indicators for each of 6¾", 8½" and 11", which are standard booklet heights. It will be understood that various other configurations of position indicators 32, including various other indicia 34 arrangements and pointers 36, may be incorporated in the present invention. While the parenthetical marks indicating the booklet height are illustrated at specific locations, it will be understood that such positions are for illustration purposes only.

Figure 6:
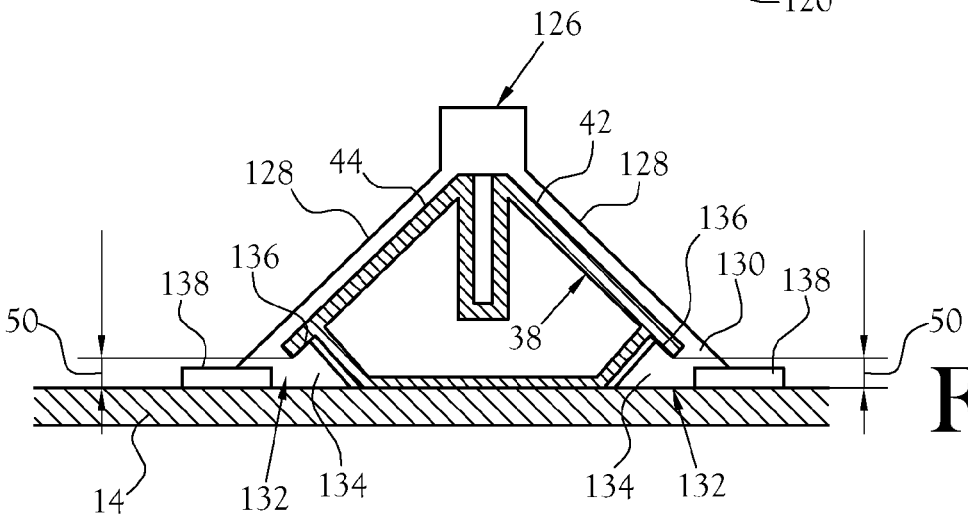
FIG. 6 is a side elevation, in cross-section taken along lines 6-6 of FIG. 2, of the saddle stitcher of the present invention, showing in greater detail the engagement between a width adjuster and the saddle.

The saddle 38 is carried within the tray 12 and extends between the first and second side walls 24, 26. The saddle 38 is provided for receiving a plurality of pages 142 to be formed into a booklet 140 thereon, and for supporting the pages 142 as they are being stapled to form the booklet 140. The cross-sectional configuration of the saddle 38 is best illustrated in FIGS. 3, 4 and 6.

Figure 3:
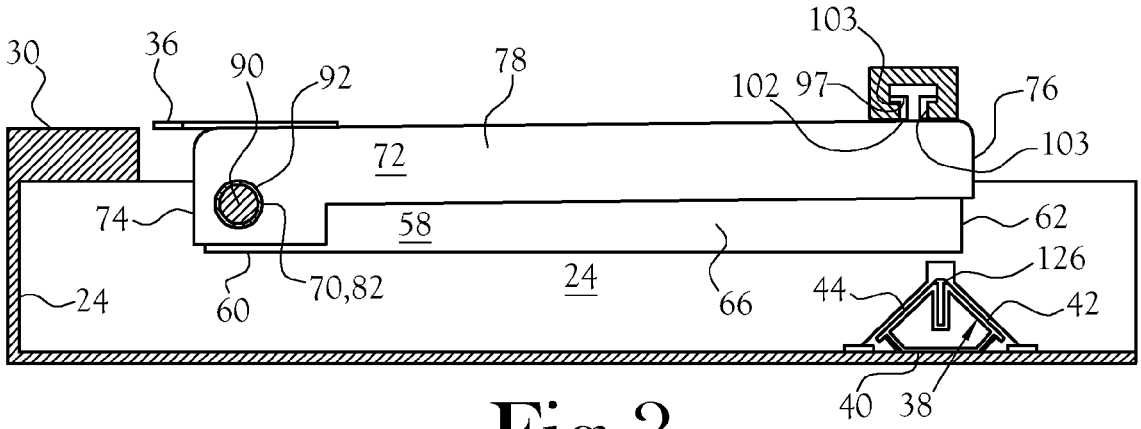
FIG. 3 is a side elevation, in cross section taken along lines 3-3 of FIG. 1, of the saddle stapler of the present invention showing a stapler engaged with a sliding receiver.
Figure 4:
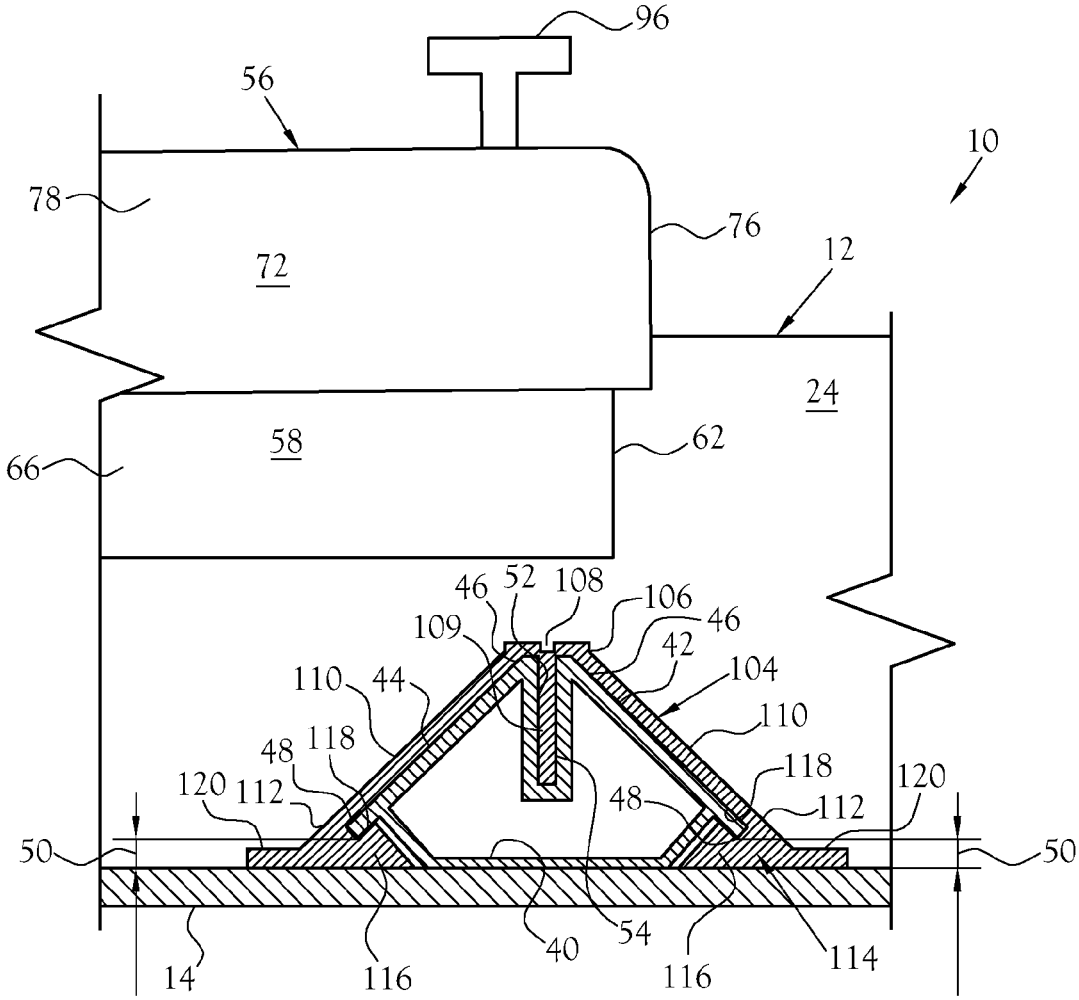
FIG. 4 is a side elevation, in cross-section taken along lines 4-4 of FIG. 2, of the saddle stitcher of the present invention, showing in greater detail the engagement between a stapler head and a sliding clincher plate, as well as the engagement between the clincher plate and the saddle.

Referring to FIGS. 3 and 4, the saddle 38 includes primarily a base 40 for mounting the saddle 38 onto the tray 12. First and second engagement surfaces 42, 44 are provided for supporting the plurality of pages 142. As illustrated, the engagement surfaces 42, 44 are disposed at opposite angles with respect to vertical. As will be discussed in greater detail below, prior to being stapled, the pages 142 forming a booklet 140 are folded to define a fold line 144. The engagement surfaces 42, 44 thus allow for the folded pages to be supported when placed on the saddle 38 in such a manner as to nest. In so doing, the fold line 144 on each page 142 is substantially aligned with the fold line 144 of each other page 142, and in alignment with a longitudinal axis of the saddle 38.

The first and second engagement surfaces 42, 44 define an upper edge 46 and a lower edge 48. The lower edge 48 terminates above the bottom wall 14 of the tray 12 to define a gap 50. A receiver 52 is defined along the length of the saddle 38 between the upper edges 46 of the first and second engagement surfaces 42, 44. The receiver 52 is configured to slidably receive a plurality of clincher plates 104. In the illustrated embodiment, the receiver 52 defines a substantially rectangular groove 54. However, it will be understood that other configurations would work with similar success.

Figure 5:
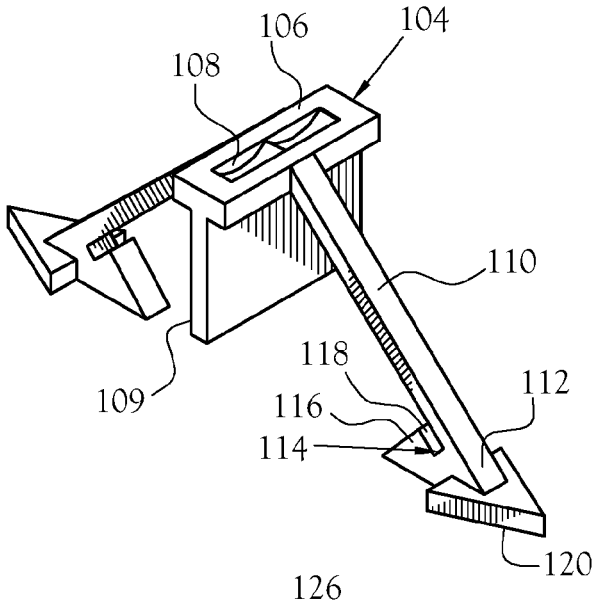
FIG. 5 is a perspective illustration of a sliding clincher plate used as a feature of the saddle stitcher of the present invention.

A plurality of clincher plates 104 is slidably received on the saddle 38. FIG. 5 is a perspective illustration of a clincher plate 104. Each clincher plate 104 defines an anvil 106, which in turn defines a clinching recess 108. The anvil 106 defines an extended portion 109 configured to be received within the receiver 52 defined by the saddle 38. The clinching recess 108 is configured to engage the points of a staple 88 and deform the staple 88 such as to clinch the staple 88 onto a bottom sheet of paper 142 forming the innermost page of the booklet 140. Each clincher plate 104 defines a pair of legs 110 configured to be received over the first and second engagement surfaces 42, 44 of the saddle 38. One each of the legs 110 extends from the clincher plate 104 and is configured to closely conform to the configuration of a respective one of the first and second engagement surfaces 42, 44. The distal end 112 of each leg 110 defines an engagement device 114 for engaging the lower edge 48 of the first and second engagement surfaces 42, 44, respectively. In the illustrated embodiment, the engagement device 114 includes an extended portion 116 configured to extend through the gap 50 defined between the engagement surface lower edge 48 and the tray bottom wall 14. The engagement device 114 defines a notch 118 for receiving the lower edge 48 of the engagement surface 42, 44 such that the clincher plate 104, once installed, is prevented from unselected removal.

The distal end 112 of each leg 110 defines a pointer 120 for indicating the position of the clincher plate 104 with respect to the saddle 38. To this extent, indicia 122, 124 are carried on the bottom wall 14 of the tray 12. As with the indicia 34 cooperating with the stapler position indicator 32, it will be understood that the indicia 122, 124 may include a standard ruler configuration to illustrate the distance from the first side wall 24, may indicate a position at which the clincher plate 104 is to be disposed for a particular size paper 142, or may indicate both. In the illustrated embodiment, a first set of clincher plate positioning indicia 122 is disposed proximate the lower edge 48 of the first engagement surface 42 and a second set of clincher plate positioning indicia 124 is disposed proximate the lower edge 48 of the second engagement surface 44. The first set of indicia 122 includes a conventional ruler to indicate the distance from the first side wall 24 of the tray 12. The second set of indicia 124 is provided for indicating standard positions for the clincher plates 104 for selected booklet sizes. In the illustrated embodiment, the stapler positioning indicia 34 and the first and second sets of clincher plate positioning indicia 122, 124 are aligned. As such, when the staplers 56 and clincher plates 104 are all selectively positioned with respect to their respective indicia 34 and 122, 124, they are aligned with respect to each other as well.

Figure 7:
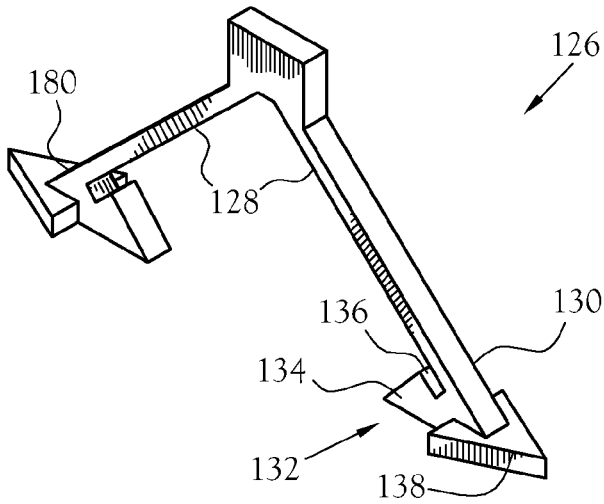
FIG. 7 is a perspective illustration of a width adjuster used as a feature of the saddle stitcher of the present invention.

A width adjuster 126 is illustrated most clearly in FIGS. 6 and 7 and is provided for aligning each of the sheets 142 being bound. The width adjuster 126 is slidably received on the saddle 38 in order to prevent each sheet 142 from movement away from the first side wall 24 of the tray 12, thus keeping the plurality of sheets 142 in alignment with each other while being stitched. Each width adjuster 126 defines a pair of legs 128 configured to be received over the first and second engagement surfaces 42, 44 of the saddle 38. The width adjuster 126 defines a pair of legs 128 configured to closely conform to the configuration of the first and second engagement surfaces 42, 44. The distal end 130 of each leg 128 defines an engagement device 132 for engaging the lower edge of the first and second engagement surfaces 42,44. In the illustrated embodiment, the engagement device 132 includes an extended portion 134 configured to extend through the gap 50 defined by the engagement surface lower edge 48 and the tray bottom wall 14. The engagement device 132 defines a notch 136 for receiving the lower edge 48 of the engagement surface 42, 44 such that the width adjuster 126, once installed, is prevented from unselected removal.

The distal end 130 of each leg 128 defines a pointer 138 for indicating the position of the width adjuster 126 with respect to the first side wall 24. To this extent, the pointers 138 cooperate with the indicia 122, 124 carried on the bottom wall 14 of the tray 12 and also utilized by the clincher plates 104. The pointers 138 and the indicia 122, 124 assist a user in aligning the width adjuster 126 prior to the placement of the plurality of sheets 142 to be formed into a booklet 140. However, it will be understood that due to inconsistencies in the measurement of the sheets 142, it may be necessary to move the width adjuster 126 toward or away from the first side wall 124 when the sheets 142 are placed on the saddle 38. To this extent, the width adjuster 126 is useful in aligning the sheets 142 with each other prior to stitching.

Figure 8:
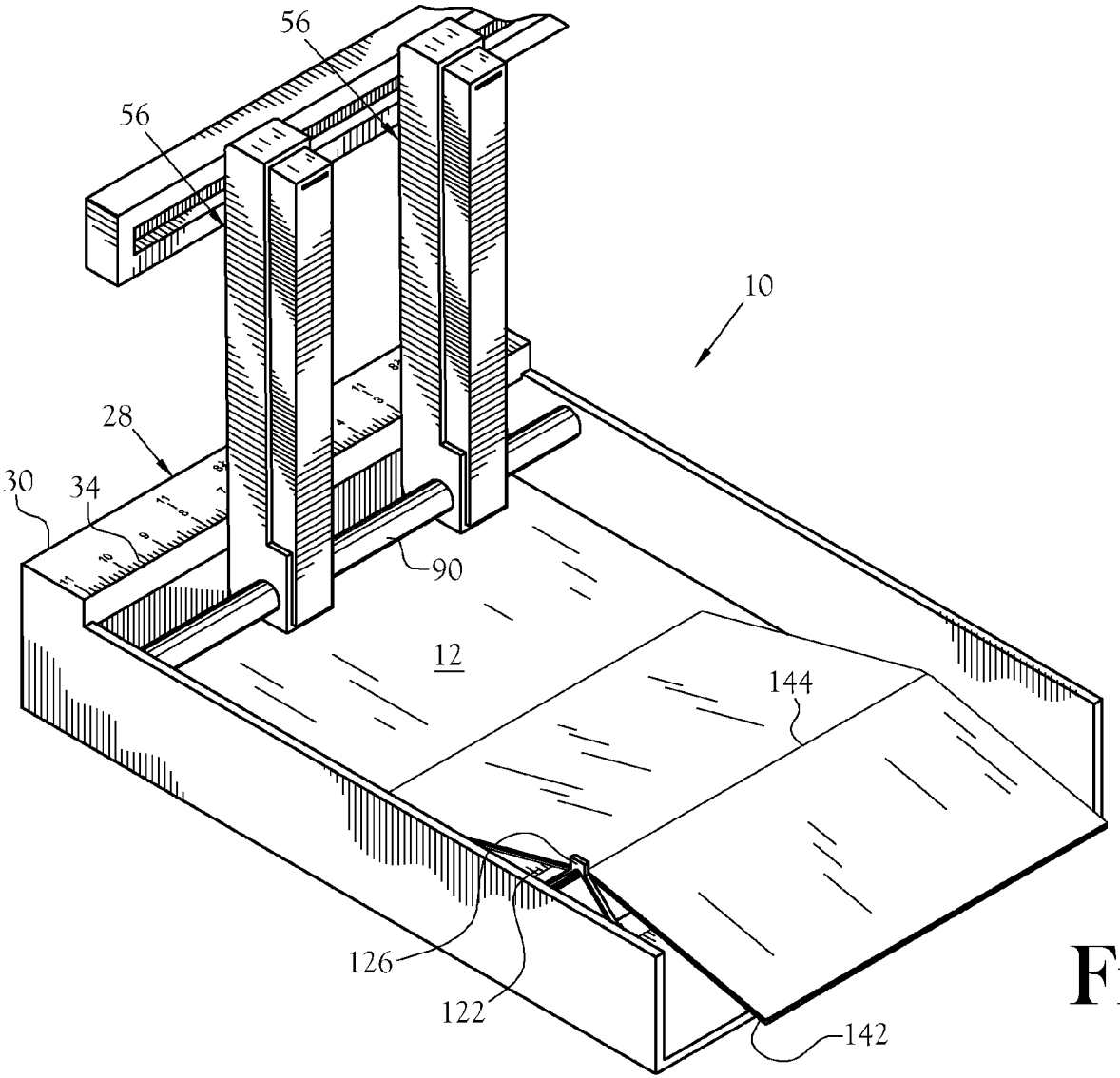
FIG. 8 is a perspective illustration of the saddle stitcher of the present invention showing a plurality of sheets of paper being folded and received therein for stitching to form a booklet.
Figure 9:
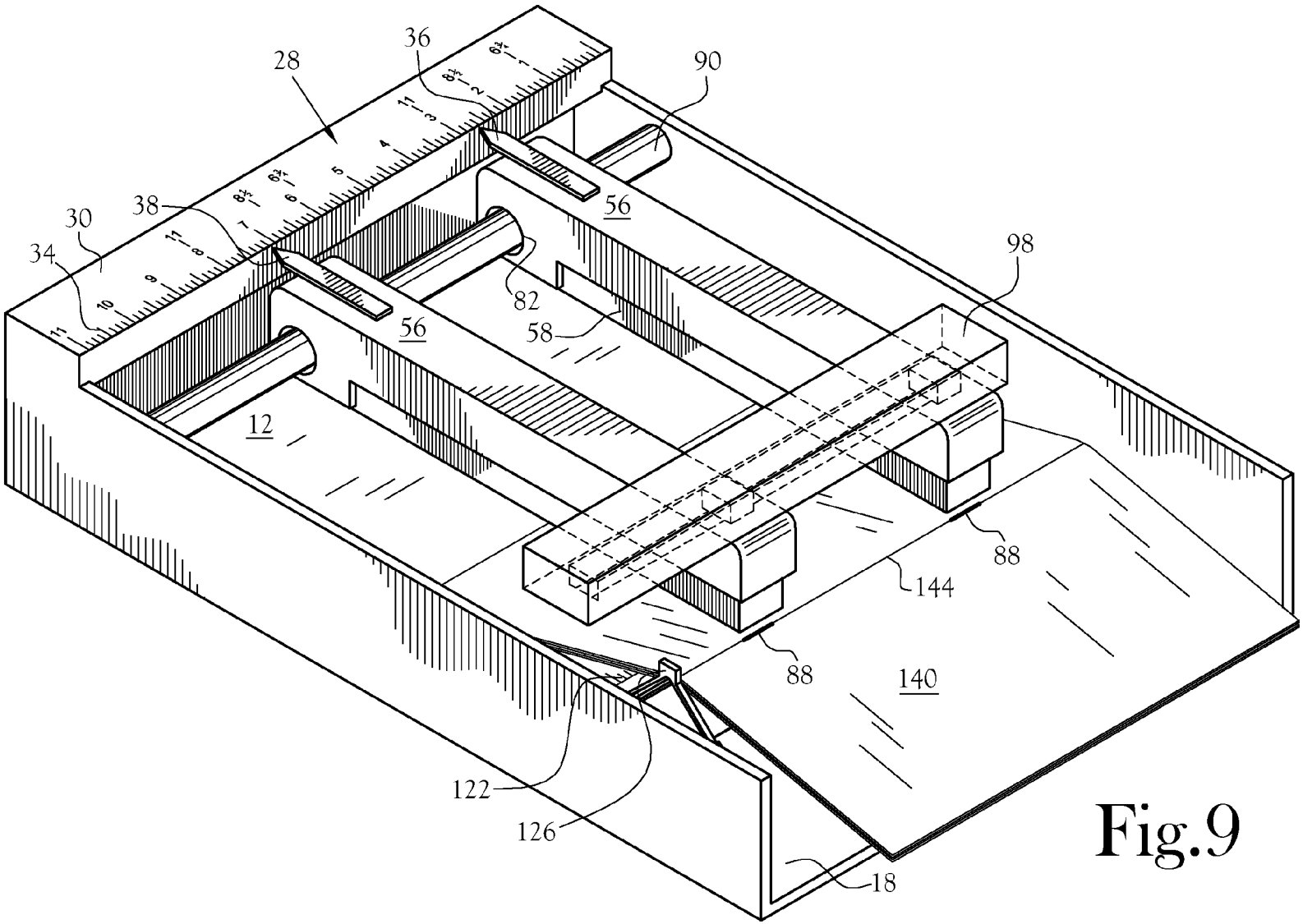
FIG. 9 is a perspective illustration of the saddle stapler of the present invention as illustrated in FIG. 8 showing the stapler heads engaged for stitching a booklet.
Figure 10:
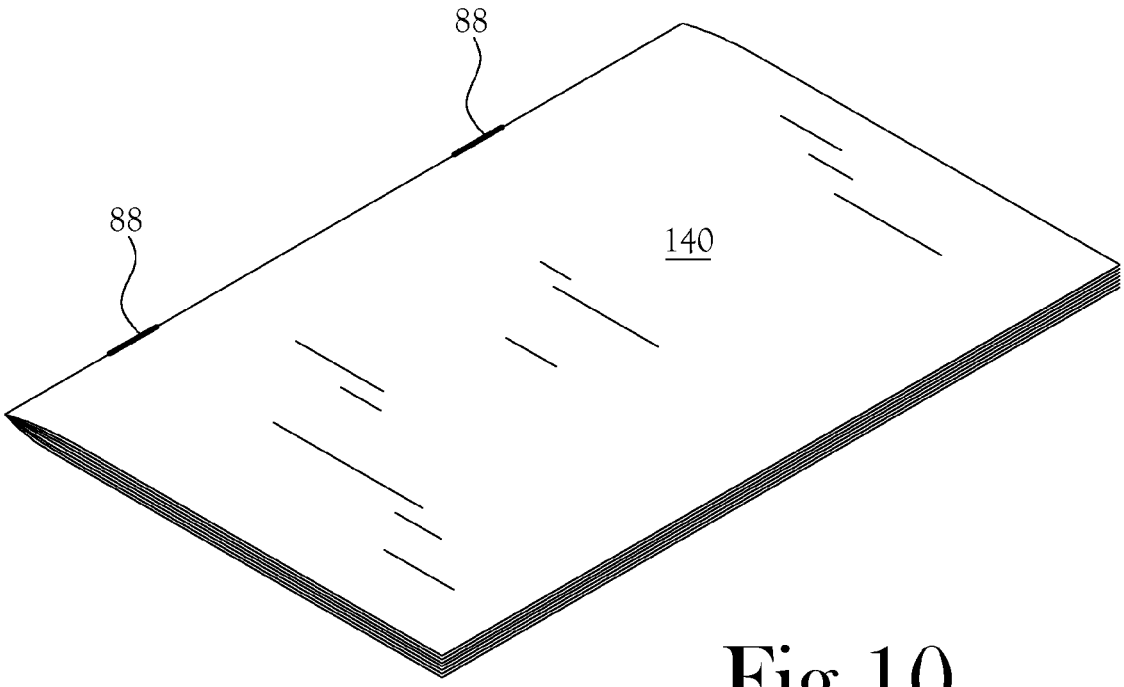
FIG. 10 is a perspective illustration of a booklet assembled using the saddle stitcher of the present invention.

FIGS. 8-10 illustrate a method of fabricating a booklet 140 from a plurality of sheets 142 using a saddle stitcher 10 of the present invention. The clincher plates 104 are first moved to selected positions along the saddle 38 as determined by the height of the sheets 142. The staplers 56 are likewise moved along the rod 90 to positions corresponding to the clincher plates 104. Then, as illustrated in FIG. 8, the staplers 56 are pivoted about the rod 90 to a vertical orientation to allow substantially unencumbered access to the saddle 38. The width adjuster 126 is moved along the saddle 38 to the approximate height of the sheets 142, and the sheets 142 are then placed on the saddle 38. A user may fold each of the plurality of sheets 142 prior to placement on the saddle 38 to define a fold line 144, and whereby the sheets 142 nest within each other when placed on the saddle 38. The width adjuster 126 is then moved to a position whereby the sheets 142 are aligned with each other and are held securely against the first side wall 24.

As illustrated in FIG. 9, the staplers 56 are then lowered to engage the top sheet 142. The elongated push board 98 is then placed such that the posts 96 on the stapler covers 72 are received within the groove 102. Force is then applied to the push board 98 such that each of the staplers 56 is actuated to apply a staple 88 to the sheets 142. As illustrated in FIG. 10, the booklet 140 is then removed from the saddle stitcher 10.

Thus, a saddle stitcher for assembling paperback books is provided. The saddle stitcher is provided for manually assembling one or a few booklets in a cost-effective, yet professional manner. The saddle stitcher is configured to accommodate various sizes of paper. Further, the saddle stitcher is configured to allow for unencumbered placement of paper to be stitched and removal of a booklet after a plurality of stitches in the form of staples has been applied.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants general inventive concept.

Having thus described the aforementioned invention, what is claimed is:

1. A saddle stitcher comprising:

a tray for receiving a plurality of pages to be made into a booklet and in which the pages are stitched to form the booklet, said tray including at least a bottom wall, a first side wall and a second side wall;

a saddle received within said tray and extending substantially between said first side wall and said second side wall; and a plurality of staplers for stitching the plurality of pages to form the booklet, each of said plurality of staplers defining a proximal end and a distal end, said plurality of staplers being mounted within said tray such that said distal end is selectively engaged with said saddle, each of said plurality of staplers being limited to linear movement toward and away from said first side wall and pivotal movement about an axis extending between said proximal end of each of said plurality of staplers in order to selectively move said distal end of each of said plurality of staplers toward and away from engagement with said saddle.

2. The saddle stitcher of claim 1 wherein said tray further includes a first end wall disposed at a first end of said bottom wall.

3. The saddle stitcher of claim 1 further comprising a rod defining a cylindrical cross-section and extending substantially between said first side wall and said second side wall, each of said plurality of staplers proximal end defining a through opening for receiving said rod in order to accomplish said linear movement toward and away from said first side wall and said pivotal movement about an axis extending between said proximal end of each of said plurality of staplers, said axis coinciding with a longitudinal axis of said rod.

4. The saddle stitcher of claim 1 further comprising a stapler engagement device for engaging each of said plurality of staplers in tandem in order to actuate each of said plurality of staplers simultaneously.

5. The saddle stitcher of claim 4 wherein said stapler engagement device includes:

a post mounted on a top surface of each of said plurality of staplers proximate said distal end, carried by the cover of each stapler, proximate the distal end thereof; and a push board defining a length to extend between said post on each of said plurality of staplers when said plurality of staplers are spaced apart a maximum distance, said push board defining a bottom surface having a groove formed therein for closely receiving said post carried by each of said plurality of staplers.

6. The saddle stitcher of claim 1 further comprising a stapler position indicator for assisting in properly positioning each of said plurality of staplers with respect to said first side wall.

7. The saddle stitcher of claim 6 wherein said stapler position indicator includes:

a set of stapler positioning indicia carried on said tray proximate said proximal end of said plurality of staplers; and a pointer carried by each of said plurality of staplers proximate said proximal end and configured to cooperate with said stapler positioning indicia to indicate a position from said first side wall.

8. The saddle stitcher of claim 1 further comprising a plurality of clincher plates slidably received on said saddle, each of said plurality of clincher plates defining an anvil defining a clinching recess for receiving and deforming a staple to form the booklet.

9. The saddle stitcher of claim 8 wherein said saddle includes:

a base for mounting said saddle on said bottom wall of said tray;

first and second engagement surfaces carried by said base, each of said first and second engagement surfaces defining an upper edge and a lower edge, said lower edge terminating above said bottom wall of said tray to define a gap; and a receiver defined along the length of said saddle between said upper edge of said first engagement surface and said upper edge of said second engagement surface, said receiver defining a groove extending substantially between said first side wall and said second side wall; and wherein each of said plurality of clincher plates includes:

an extended portion configured to be received within said receiver defined by said saddle;

a first leg configured to be closely conform to said first engagement surface, said first leg defining a distal end defining an engagement device for engaging said lower edge of said first engagement surface, said engagement device including an extended portion configured to extend through said gap, said engagement device defining a notch for receiving said lower edge of said first engagement surface; and a second leg configured to be closely conform to said second engagement surface, said second leg defining a distal end defining an engagement device for engaging said lower edge of said second engagement surface, said engagement device including an extended portion configured to extend through said gap, said engagement device defining a notch for receiving said lower edge of said second engagement surface.

10. The saddle stitcher of claim 9 further comprising a clincher plate position indicator for assisting in properly positioning each of said plurality of clincher plates with respect to said first side wall.

11. The saddle stitcher of claim 10 wherein said clincher plate position indicator includes:

a set of clincher plate positioning indicia carried on said tray proximate said saddle; and a clincher plate pointer carried at said distal end of at least one of said clincher plate first leg and said clincher plate second leg and configured to cooperate with said clincher plate positioning indicia to indicate a position from said first side wall.

12. The saddle stitcher of claim 1 further comprising a width adjuster slidably received on said saddle for aligning the plurality of pages to prevent the plurality of pages from movement away from said first side wall of said tray.

13. The saddle stitcher of claim 12 wherein said saddle includes:

a base for mounting said saddle on said bottom wall of said tray;

first and second engagement surfaces carried by said base, each of said first and second engagement surfaces defining an upper edge and a lower edge, said lower edge terminating above said bottom wall of said tray to define a gap; and a receiver defined along the length of said saddle between said upper edge of said first engagement surface and said upper edge of said second engagement surface, said receiver defining a groove extending substantially between said first side wall and said second side wall; and wherein said width adjuster includes:

a first leg configured to be closely conform to said first engagement surface, said first leg defining a distal end defining an engagement device for engaging said lower edge of said first engagement surface, said engagement device including an extended portion configured to extend through said gap, said engagement device defining a notch for receiving said lower edge of said first engagement surface; and a second leg configured to be closely conform to said second engagement surface, said second leg defining a distal end defining an engagement device for engaging said lower edge of said second engagement surface, said engagement device including an extended portion configured to extend through said gap, said engagement device defining a notch for receiving said lower edge of said second engagement surface.

14. The saddle stitcher of claim 13 further comprising a width adjuster position indicator for assisting in properly positioning said width adjuster with respect to said first side wall.

15. The saddle stitcher of claim 14 wherein said width adjuster position indicator includes:

a set of width adjuster positioning indicia carried on said tray proximate said saddle; and a width adjuster pointer carried at said distal end of at least one of said width adjuster first leg and said width adjuster second leg and configured to cooperate with said width adjuster positioning indicia to indicate a position from said first side wall.

* * * * *